US008037670B2

(12) United States Patent
Ikemura

(10) Patent No.: US 8,037,670 B2
(45) Date of Patent: Oct. 18, 2011

(54) BI-DIRECTIONAL CONVERTER BETWEEN PRESSURE AND ROTATIONAL FORCE

(76) Inventor: Masahiro Ikemura, Kawasaki (JP)

( * ) Notice: Subject to any disclaimer, the term of this patent is extended or adjusted under 35 U.S.C. 154(b) by 489 days.

(21) Appl. No.: 12/230,884

(22) Filed: Sep. 5, 2008

(65) Prior Publication Data

US 2010/0061873 A1 Mar. 11, 2010

(51) Int. Cl.

| | |
|---|---|
| ***F01C 1/18*** | (2006.01) |
| ***F01C 21/18*** | (2006.01) |
| ***F01C 1/20*** | (2006.01) |
| ***F04C 2/18*** | (2006.01) |
| ***F04C 18/18*** | (2006.01) |
| ***F02B 53/00*** | (2006.01) |
| ***F02B 53/04*** | (2006.01) |

(52) U.S. Cl. ..... 60/39.6; 123/238; 418/196; 418/206.5

(58) Field of Classification Search ..... 60/39.6, 60/39.62, 39.78; 123/238, 236; 418/196, 418/205, 206.1, 206.2, 206.5

See application file for complete search history.

(56) References Cited

U.S. PATENT DOCUMENTS

| | | | | |
|---|---|---|---|---|
| 597,274 | A * | 1/1898 | Engberg | 418/206.1 |
| 1,923,500 | A * | 8/1933 | Northey | 123/238 |
| 2,058,817 | A * | 10/1936 | Northey | 123/238 |
| 2,724,340 | A * | 11/1955 | Tryhorn | 418/196 |
| 4,432,314 | A * | 2/1984 | Pelekis | 123/238 |

FOREIGN PATENT DOCUMENTS

| | | |
|---|---|---|
| JP | 62-76202 | 5/1987 |
| JP | 9-264152 | 10/1997 |
| JP | 2005-315205 | 11/2005 |
| JP | 2007-224894 | 9/2007 |

* cited by examiner

*Primary Examiner* — Mary A Davis

(74) *Attorney, Agent, or Firm* — Rabin & Berdo, PC

(57) ABSTRACT

A bi-directional converter between pressure and rotational force includes engaging rotation members that continue to rotate while being adjacent to each other without collision; the rotation members and an outer wall form an enclosed space; rotation shafts of the rotation members are mutually engaged by gear wheels; the rotation members are synchronized and rotate in opposite directions; the rotation members are rotated by a volume change of the enclosed space by application of pressure from outside; and the volume of the enclosed space is changed by rotational force to generate a pressure difference. The bi-directional converter includes an open-close mechanism opening and closing supply exhaust paths inside the rotation member and disposed to the rotation shaft or the outer wall according to a rotation angle.

15 Claims, 18 Drawing Sheets

BI-DIRECTIONAL CONVERTER BETWEEN PRESSURE AND ROTATIONAL FORCE

BACKGROUND OF THE INVENTION

1. Field of the Invention

The present invention relates to a bi-directional converter between pressure and rotational force applicable to a turbine, a pump, an engine, and flow measurement.

2. Description of Related Art

In a related art apparatus of pressure and rotational force including rotation members to be engaged, none of such a related art apparatus is capable of bi-directionally converting the pressure and the rotational force at all rotation angles by a pair of rotation members.

Patent Document 1: Japanese Patent Application No. 2006-84161

Patent Document 2: Japanese Utility Model Registration Application No. 62-76202

Patent Document 3: Japanese Patent Application No. 2004-135417

Patent Document 4: Japanese Patent Application No. H8-112958

The present invention is to provide an apparatus bi-directionally converting pressure and rotational force at all of rotation angles, in conversion of pressure difference into rotational force and the rotational force into the pressure difference by enclosed space formed by engagement of the rotation members adjacent to each other, with a simple structure having a small number of malfunction elements.

BRIEF SUMMARY OF THE INVENTION

According to an aspect of the present invention, a bi-directional converter between pressure and rotational force includes: first and second rotation members, disposed next to each other while overlapping a portion of each of outer circumference tracks thereof, having different rotation shafts, each of the outer circumference tracks being in a circular cylinder shape; a circumference outer wall adjacent to the outer circumference track of each of the first and the second rotation members; a side surface outer wall, adjacent to a side surface of each of the rotation members, serving as a surface in a direction perpendicular to the rotation shafts of respective the rotation members; enclosed space formed by each of the rotation members, the circumference outer wall, and the side surface outer wall; and a supply exhaust path communicating an outer side of the circumference outer wall with an outer side of the side surface outer wall. One of the rotation shafts of the first and the second rotation members rotates in such a manner to synchronize with the other rotation member rotating in the opposite direction. Each of the first and the second rotation members includes a protrusion portion serving as an outer protrusion, being adjacent to the circumference outer wall, and protruding from a base in a substantially circular shape, and includes a convex portion, serving as an inner protrusion, disposed at an inner circumference side relative to the outer circumference track, the convex portion becoming adjacent to the outer protrusion of another rotation member in a course of engagement of the first and the second rotation members. The outer protrusion of the first rotation member is curved in a retard direction with respect to a rotation direction and forms an arc at a front surface of the outer protrusion in the rotation direction while forming a recess in a curve shape from a rotation direction rear surface to a tip of the inner protrusion of the outer protrusion so as to form a curve surface successively adjacent to the outer protrusion of the second rotation member in contact with the first rotation member. The outer protrusion of the second rotation member is curved in an advance direction with respect to a rotation direction and forms an arc at a rear surface of the outer protrusion in the rotation direction while forming a recess in a curve shape from the front surface of the outer protrusion in the rotation direction to a tip of the inner protrusion of the outer protrusion so as to form a curve surface successively adjacent to the outer protrusion of the first rotation member in contact with the second rotation member. The adjacency of the tip of the outer protrusion of the second rotation member and the curve surface of the first rotation member and adjacency of a surface of the arc of the outer protrusion of the second rotation member and the curve surface of the tip of the inner protrusion of the first rotation member form two adjacent enclosed space in the course of engagement of the first rotation member and the second rotation member adjacent to each other. Adjacency of the outer protrusion of the second rotation member and the curve surface of the first rotation member makes an adjacent movement moving toward the outer protrusion from the inner protrusion. Adjacency of the circumference outer wall and the outer protrusion of the first rotation member, adjacency of the circumference outer wall and the outer protrusion of the second rotation member, and adjacency of the first rotation member and the second rotation member are formable of three adjacent enclosed space. A volume change of the enclosed space by rotation of the first and the second rotation members is converted into a pressure difference, and volume of the enclosed space is changed by the pressure applied from outside the enclosed space to convert into the rotational force of the first and the second rotation members.

According to another aspect of the bi-directional converter between the pressure and the rotational force of the present invention, each of the first rotation member and the second rotation member includes an opening of the supply exhaust path to the enclosed space.

According to another aspect of the present invention, the bi-directional converter between the pressure and the rotational force includes a side wall supply exhaust path being through the side surface outer wall and an opening of the supply exhaust path in the side surface outer wall. The rotation member includes a rotation member internal supply exhaust path communicating a rotation member opening with respect to the enclosed space with a rotation member valve opening facing the side surface outer wall. The rotation member internal supply exhaust path and the side wall supply exhaust path communicate the enclosed space with outside of the outer wall by opposition of the rotation member valve opening with respect to the side wall supply exhaust path at a prescribed rotational position around the rotation shaft of the rotation member.

According to another aspect of the bi-directional converter between the pressure and the rotational force of the present invention, the rotation shaft is secured to the side surface outer wall through a center of the rotation member. The rotation member rotates around the rotation shaft and includes a rotation member internal supply exhaust path communicating a rotation member opening with respect to the enclosed space with a rotation member valve opening facing the rotation shaft. The rotation shaft of the rotation member includes a rotation shaft internal supply exhaust path extending inside thereof in an axis direction from a rotation shaft first valve opening facing the rotation member. The rotation member internal supply exhaust path and the rotation shaft internal supply exhaust path make the rotation member valve opening and the rotation shaft first valve opening be opposite to each other at a prescribed rotation position around the rotation shaft of the rotation member.

According to another aspect of the present invention, the bi-directional converter between the pressure and the rotational force includes a rotation shaft support member rotatably support the rotation shaft integrally rotating with the rotation member. The rotation member includes a rotation member rotation shaft internal supply exhaust path communicating with a rotation shaft second valve opening facing the rotation shaft support member through inside the rotation member and the rotation shaft from a rotation member opening with respect to the enclosed space. The rotation shaft support member includes a rotation member bearing opening having a support member internal supply exhaust path communicating outside the rotation shaft support member and to the rotations haft. The rotation member rotation shaft internal supply exhaust path and the support member internal supply exhaust path make the rotation shaft second valve opening and the rotation member bearing opening be opposite each other at a prescribed rotation position around the rotation shaft support member of the rotation member.

According to another aspect of the bi-directional converter between the pressure and the rotational force of the present invention, each of the rotation members includes a plurality of the outer protrusions and the inner protrusions.

According to another aspect of the present invention, the bi-directional converter between the pressure and the rotational force includes a valve, disposed outside, connecting to the enclosed space. The drive of the valve and the rotation shaft of the rotation member is connected to open and close of the valve with respect to a rotation angle of the rotation member.

According to an aspect of the present invention, the bi-directional converter between the pressure and the rotational force serves as a motive power apparatus such as a turbine or an engine obtaining the rotational force from the pressure applied to the enclosed space. The motive power apparatus performs induction and compression of combustible gas based on a volume change of the enclosed space. The compressed combustible gas is temporarily stored in a compression accumulation tank disposed outside the enclosed space, and the combustible gas is exploded to obtain the rotational force by pressure of the explosion.

According to another aspect of the bi-directional converter between the pressure and the rotational force of the present invention, the pressure difference based on the volume change of the enclosed space is guided to outside by a pump through the supply exhaust path.

According to yet another aspect of the present invention, a bi-directional converter between pressure and rotational force includes: one of at least one pair of the bi-directional converters described above as a drive bi-directional converter; and another one of the pair of the bi-directional converters of described above as a load bi-directional converter. At least one of two supply exhaust paths of the drive bi-directional converter and at least one of two supply-exhaust paths of the load bi-directional converter are communicated. The drive bi-directional converter generates pressure for driving by reception of rotational force, and the load bi-directional converter rotates by the pressure for driving to drive a rotation load. A volume difference being as supply exhaust amounts of the drive bi-directional converter and the load bi-directional converter is arranged to form a transmission mechanism.

According to another aspect of the bi-directional converter between pressure and rotational force of the present invention, the load bi-directional converter drives a plurality of load bi-directional converters by communication of supply exhaust paths of the plurality of load bi-directional converters in series or parallel.

According to another aspect of the bi-directional converter between pressure and rotational force of the present invention, the supply exhaust path of a plurality of the drive bi-directional converters is communicated in parallel and rotation shafts of the drive bi-directional converters are connected to a drive source while a connection breaker and a valve are respectively disposed to the rotation shaft and the supply exhaust path of each of the drive bi-directional converters. The connection breaker and the valve of each of the drive bi-directional converters are optionally open and closed, and the rotational force of the drive bi-directional converter is serving as an input and the rotational force of the load bi-directional converter is serving as an output. A supply exhaust amount with respect to the rotational force is changed by a combination of selection of operation of the optional connection breaker and the valve to form a transmission mechanism changing rotation speed and rotation torque of the load bi-directional converter.

According to another aspect of the bi-directional converter between pressure and rotational force of the present invention, all of the supply exhaust paths are communicated inside the valve and a brake is disposed to the rotation shaft between each of the connection breaker and the drive bi-directional converter to form the transmission mechanism releasing and braking by replacement of the valve of claim 12 with the brake.

According to another aspect of the bi-directional converter between pressure and rotational force of the present invention, the supply exhaust paths of the plurality of drive bi-directional converters are communicated in parallel, and each of drive sources is connected to each of the rotation shaft of the drive bi-directional converters. The rotational force of the plurality of drive bi-directional converters is serving as an input, and the rotational force of the load bi-directional converter is serving as an output. Rotation speed and rotation torque of the plurality of drive sources are collected to the rotational force of the load bi-directional converter.

According to the bi-directional converter of the present invention, the pressure difference and the rotational force continue to be converted in bi-directions with a simple structure, and a number of elements to be lost is smaller compared to a related art apparatus relating to the pressure and rotational force. Also, the apparatus can be driven in a case of a low flow amount and a small pressure difference. The present invention can convert the pressure difference into the rotational force and can convert the rotational force into the pressure difference, thereby being applicable to a wide variety of areas. The present invention, for example, can be applied to a turbine, an engine, and a flow measurement device.

DETAILED DESCRIPTION OF PREFERRED EMBODIMENTS

First, a term "circular cylinder" used in the present invention is defined. The definition of the "circular cylinder" includes a situation in which a cross-section perpendicular to a rotation axis of a rotation member is a circle at any position on the rotation axis and a situation in which centers of the rotation axis and all of cross-sectional circles overlap. Consequently, even when each of the circles has a different diameter, it is defined as the "circular cylinder". Therefore, the circular cylinder includes a cone or a sphere and an insulator.

Figure 1:
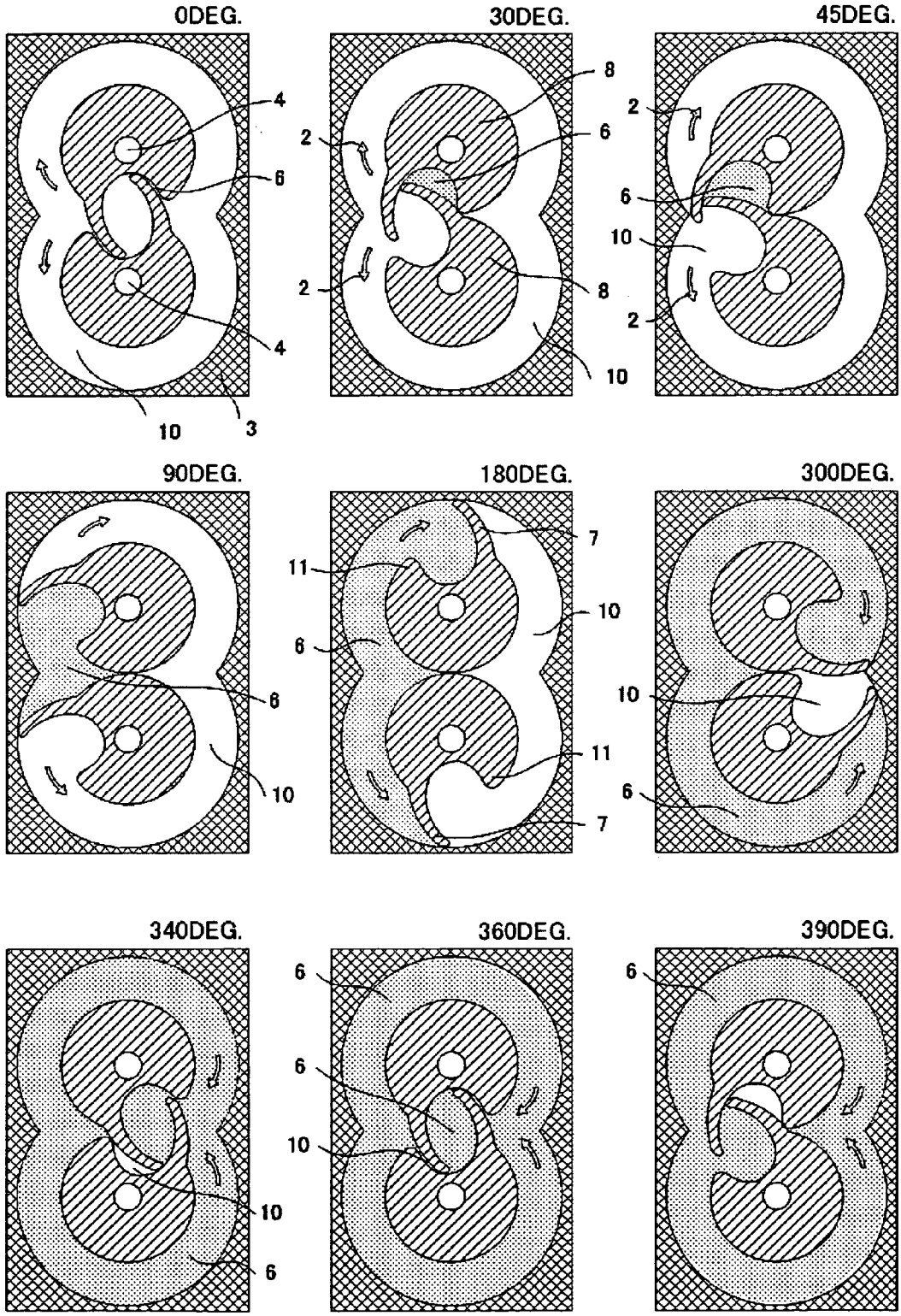
FIG. 1 are cross-sectional views illustrating angle changes of a rotation member having one outer protrusion.

As illustrated in FIG. 1, two circles to rotate are overlapped, and each of a pair of rotation members rotates in an opposite direction. The circles mutually change shapes thereof in such a manner to mutually rotate in an adjacent state, and an outer wall 3 is disposed adjacent to outer circumference tracks of first rotation members 8. In a case where such an illustration is changed from a plane view to a cubic view, each of the outer circumference tracks of the rotation members 8 is in a circular cylinder shape, and a side surface outer wall 33 is adjacent to a position perpendicular to a rotation shaft.

In FIG. 1, a reference numeral 8 represents the first rotation members, and a reference numeral 2 represents a rotation direction. Reference numerals 3 and 4 represent the outer wall and the rotation shaft, respectively.

Figure 4:
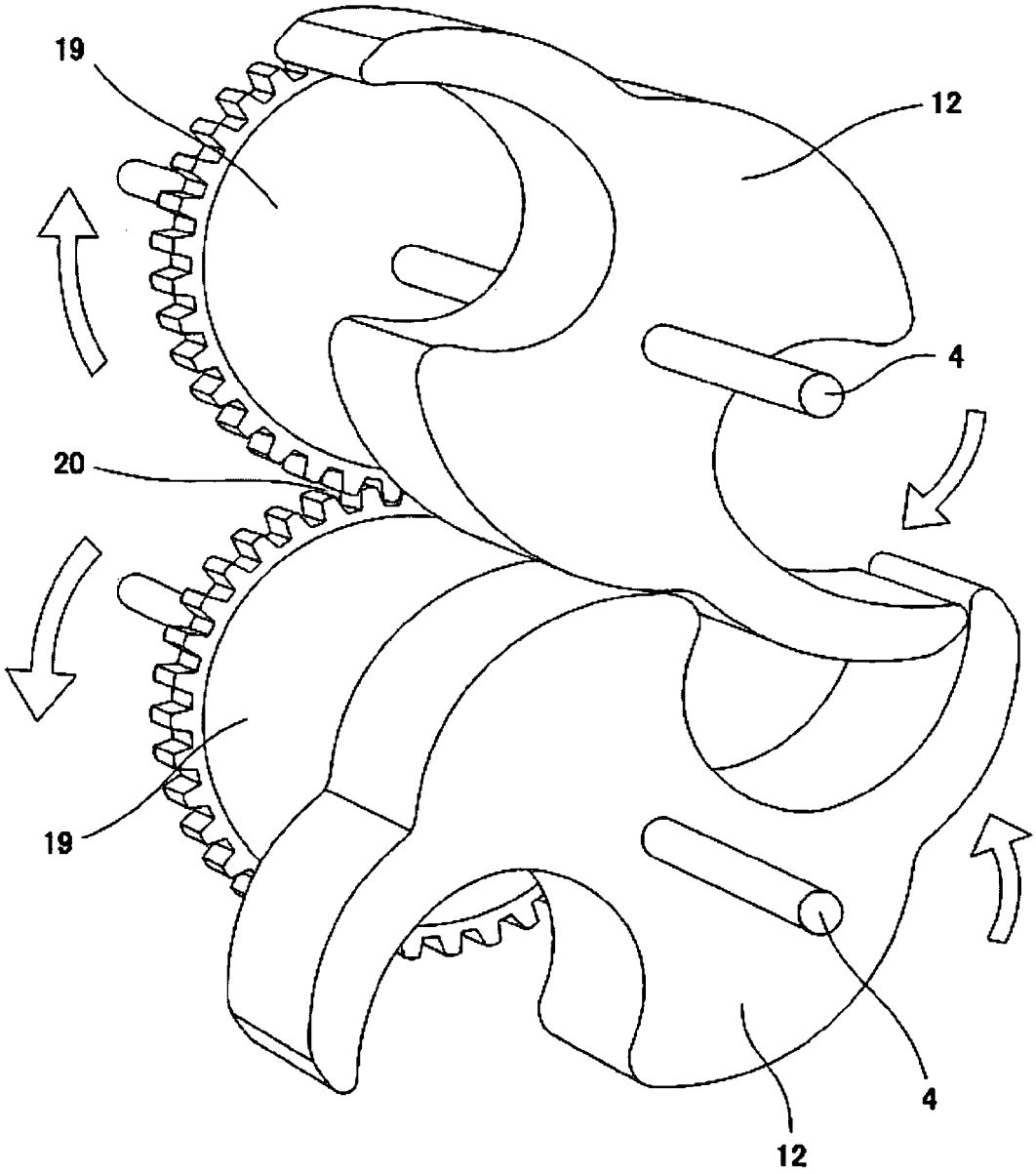
FIG. 4 is a schematic diagram illustrating synchronization of rotation of two rotation members.
Figure 12:
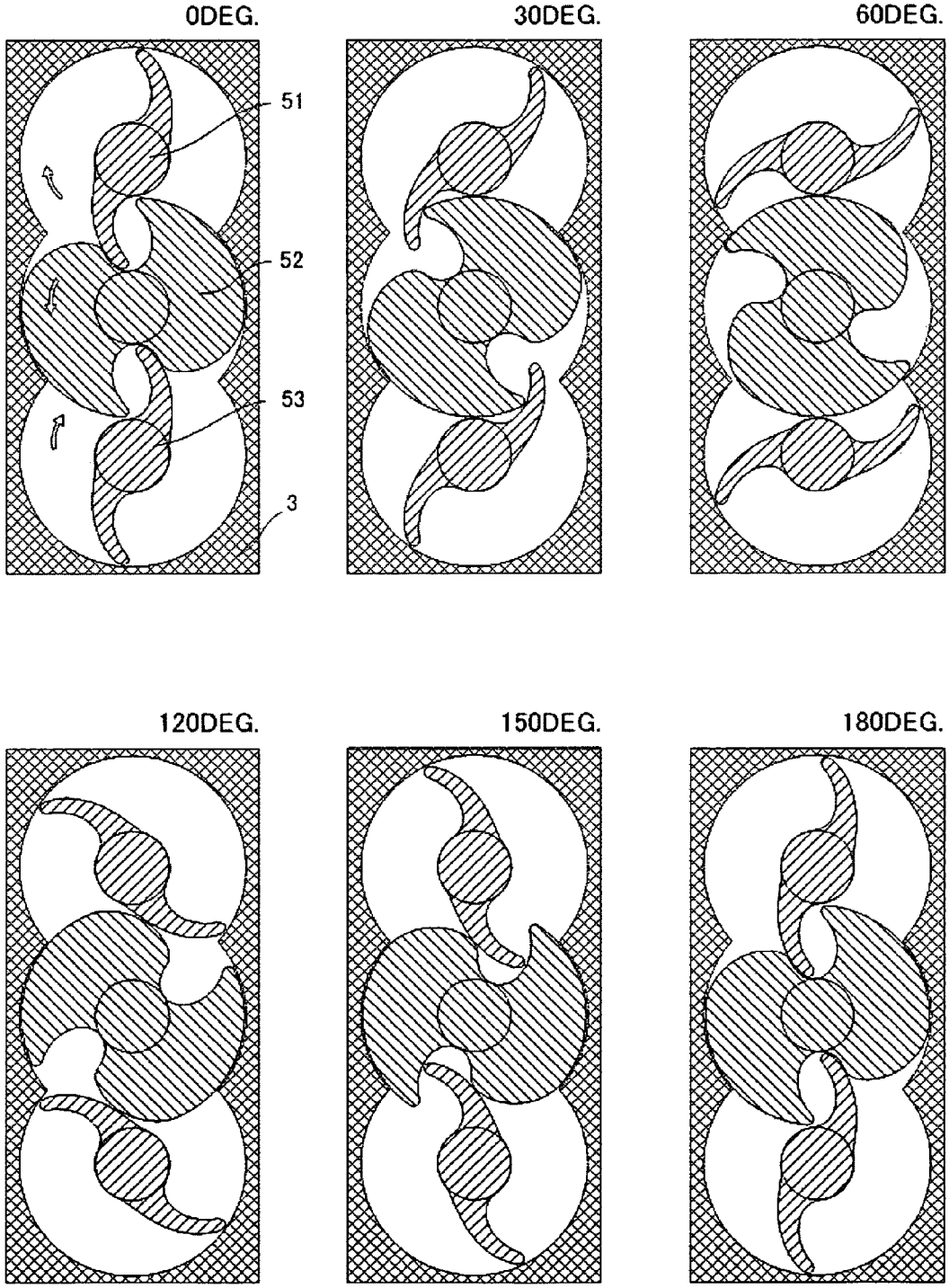
FIG. 12 are cross-sectional views illustrating angle changes of three rotation members.
Figure 13:
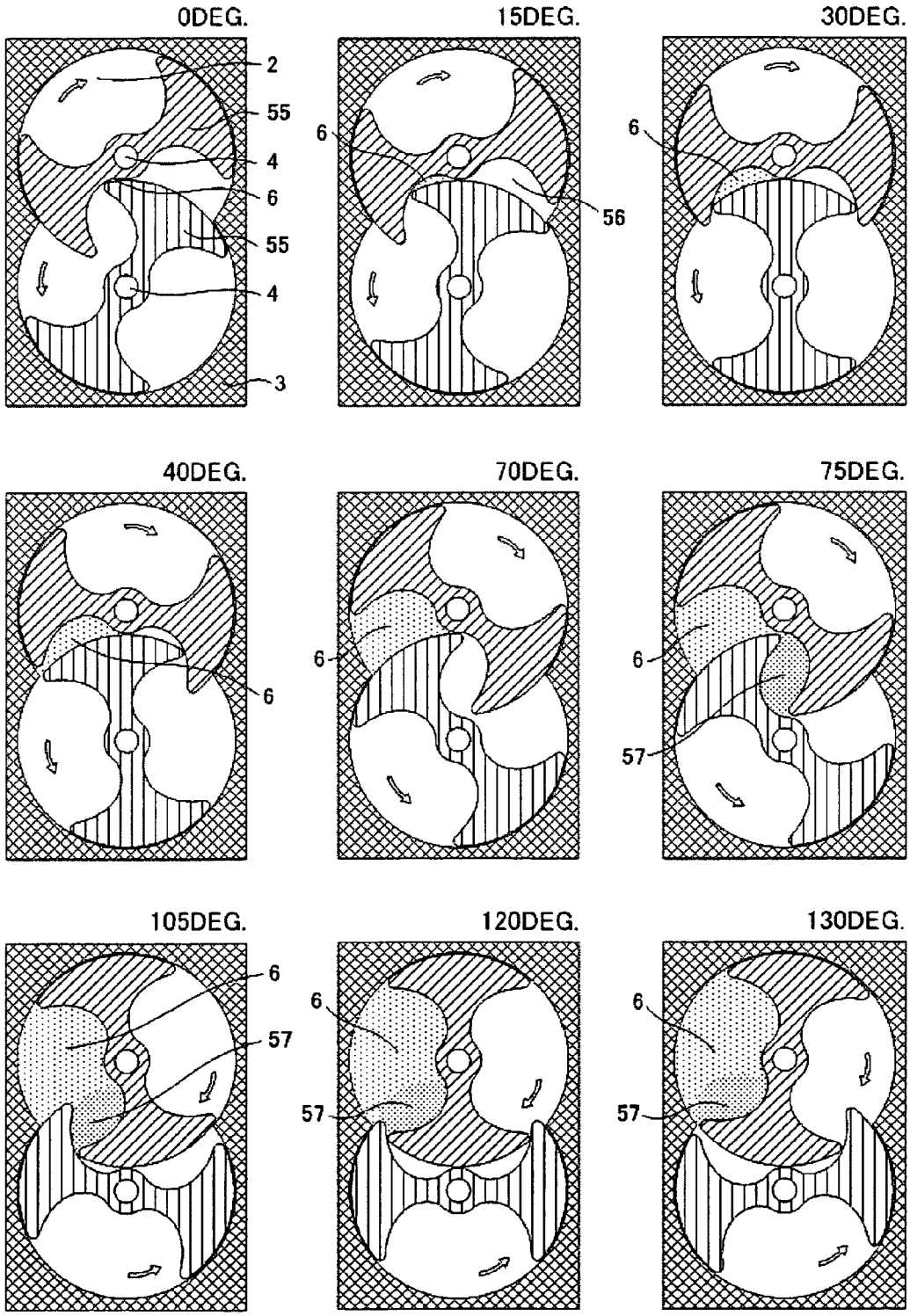
FIG. 13 are cross-sectional views illustrating angles changes of rotation members forming a complex shape of enclosed space (a shape of a rotation member other than the present invention)

Descriptions with reference to FIGS. 1, 2, 7, 10, 11, 12, 13, 14, 15, 16, 17, 18, 19, 20, 21, and 22 are given with cross-sectional views all of which describe a shape of the rotation member according to the present invention except for FIG. 13. Each of the cross-sectional views includes a mechanism having a rotation ratio of 1:1 by a gear so that each of the rotation members rotates in the opposite direction. The rotation members or the rotation members and the outer wall are shaped in such a manner not to collide each other while being adjacent to each other. A gear wheel illustrated in FIG. 4 is an example mechanism to synchronize the rotation. Alternatively, a chain or a belt and a shaft may be employed to form a rotation synchronization mechanism in an opposite direction.

As illustrated in FIG. 1, the rotation members 8 disposed one above another and the outer wall 3 form first enclosed space 6. A volume of the first enclosed space 6 is changed by an angle of the rotation members 8. Use of such a volume change can not only convert a pressure difference into rotational force, but also can generate the pressure difference using the rotational force. Each of degrees of the angles stated in FIG. 1 indicates the angle of the rotation members 8.

Each of segmental views has a reference angle of zero (0) degree for the sake of simplicity and illustrates a state of a rotation angle of each of the rotation members. It is assumed that rotation members adjacent to each other rotate without colliding with each other, and the enclosed space formed by the rotation members adjacent to each other and the outer wall is enclosed without a gap. According to the present invention, a shape of the rotation member can be an important element to determine a capability of the bi-directional converter.

FIG. 13 illustrates an example of rotation members that are considered to be in a shape by which the rotation members continue to be adjacent to each other. A rotation of third rotation members 55 is observed while observing first enclosed space 6. A volume of the first enclosed space 6 changes in the course of mutual rotation of the third rotation members 55. The first enclosed space 6 is generated where each of the third rotation members 55 has a rotation angle of zero (0) degree, and the volume thereof increases until the rotation angle of the third rotation member 55 reaches approximately one hundred and twenty (120) degrees. Also, fifth enclosed space 57 is added at the rotation angle of seventy five (75) degrees. With the shape of the third rotation member 55, not only the first enclosed space 6 and the fifth enclosed space 57, but also additional enclosed space exists, causing an increase of complication to form a converter of the pressure and the rotational force. Therefore, such a shape of the third rotation members 55 is not applicable for the bi-directional converter between the pressure and the rotational force.

As illustrated in FIG. 1, the volume of the first enclosed space 6 formed by the first rotation members 8 and the outer wall 3 increases as the rotation angle of the first rotation members 8 increases from zero (0) degree to three hundred and sixty (360) degrees. The volume of the first enclosed space 6 decreases and is eliminated in a next rotation of the rotation members 8. Since the first enclosed space 6 is temporarily separated at approximately three hundred and forty (340) degrees and is integrated at approximately three hundred and ninety (390) degrees of the rotation angle of the pair of rotation members 8, the first enclosed space 6 is substantially the same as a situation of being not separated. Therefore, the volume of the first enclosed space 6 can increase from zero (0) percent to one hundred (100) percent and can decrease from one hundred (100) percent to zero (0) percent, and such first rotation members 8 can be in a suitable shape and a basic pattern according to the present invention.

Figure 2:
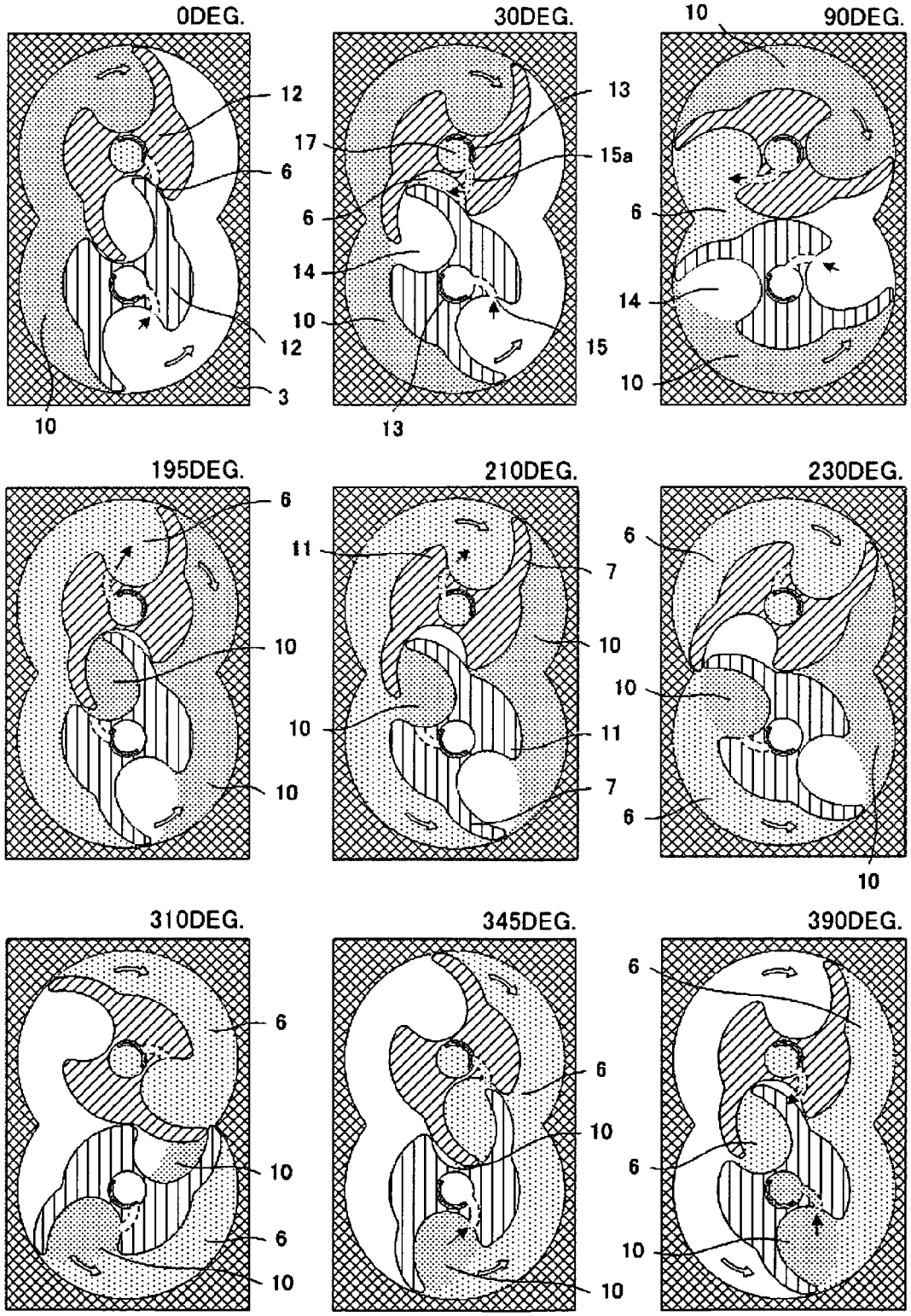
FIG. 2 are cross-sectional views illustrating angle changes of a rotation member having two outer protrusions and a supply exhaust open-close mechanism of a rotation shaft.

Referring to FIG. 2, a bi-directional converter includes a supply exhaust mechanism inside of each of rotation members, and each of the rotation members includes two outer protrusions 7. A volume of first enclosed space 6 increases as the rotation angle increases from zero (0) degree to one hundred ninety five (195) degrees. Where the rotation angle increases from one hundred ninety five (195) degrees to two hundred thirty (230) degrees, second enclosed space 10 that is a portion of the volume to be exhausted in a half-rotation ahead is added. The volume of the first enclosed space 6 with the second enclosed space 10 is separated at the rotation angle of three hundred forty five (345) degrees, and is transferred to enclosed space to be exhausted in a half-rotation behind at the rotation angle of three hundred ninety (390) degrees. The volume of the first enclosed space 6 begins to decrease where the rotation angle is three hundred forty five (345) degrees at which the volume thereof is substantially the same as that at the rotation angle of one hundred ninety five (195) degrees. In consideration of a high-speed rotation, in a case where a rotation shaft serves as a center of gravity of the rotation member such as a second rotation member 12, stress caused by the high-speed rotation can be reduced.

Figure 3:
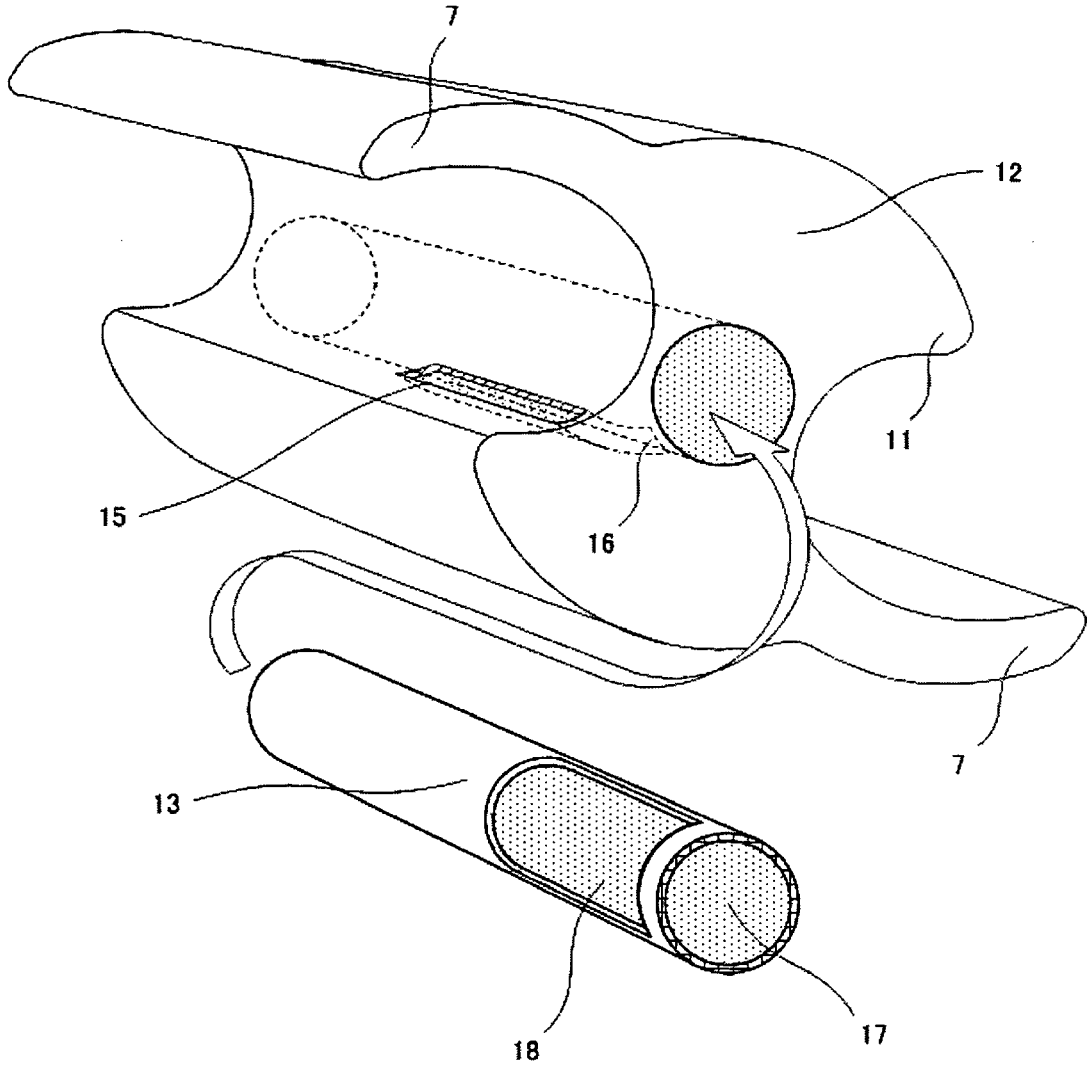
FIG. 3 is an assembly diagram illustrating the rotation member having the supply exhaust open-close mechanism in the rotation shaft.

Referring to FIG. 3, the second rotation member 12 includes a rotation shaft 13 being at a standstill disposed in a center thereof and the supply exhaust mechanism capable of opening and closing by the rotation angle thereof. The rotation shaft 13 includes a valve mechanism therein and is secured to the side surface outer wall 33 through inside the rotation member 12. The second rotation member 12 rotates around the rotation shaft 13 serving as an axis thereof. A rotation shaft valve opening 18 and a rotation member opening 15 are connected by the rotation angle of the rotation member 12, thereby forming the valve mechanism opening and closing depending upon the rotation angle of the rotation member 12. Other components are omitted from FIG. 3 for the sake of simplicity. An element substantially the same as the rotation member opening 15 is disposed in a position being symmetrical in relation to a center point of the rotation member 12. Another element substantially the same as the rotation shaft valve opening 18 is disposed in a position being symmetrical in relation to a center point of the rotation shaft 13 having the valve mechanism. In other words, supply and exhaustion are also performed in a concave portion of the rotation member 12 at an opposite side of FIG. 3.

As illustrated in FIG. 4, the second rotation members 12 and rotational synchronization gear wheels 19 integrally rotate with respective rotation shafts 4. An engagement portion 20 of the rotational synchronization gear wheels 19 rotationally moves in the same direction, thereby each of the rotation members 12 rotates in the opposite direction. The rotational synchronization gear wheels 19 are engaged, so that the rotation members 12 continue to be adjacent to each other without collision. When the volume of the enclosed space formed by the second rotation members 12 is changed by the rotation angle, the rotational force is generated by the pressure difference, and the pressure difference is generated by application of the rotational force.

Figure 5:
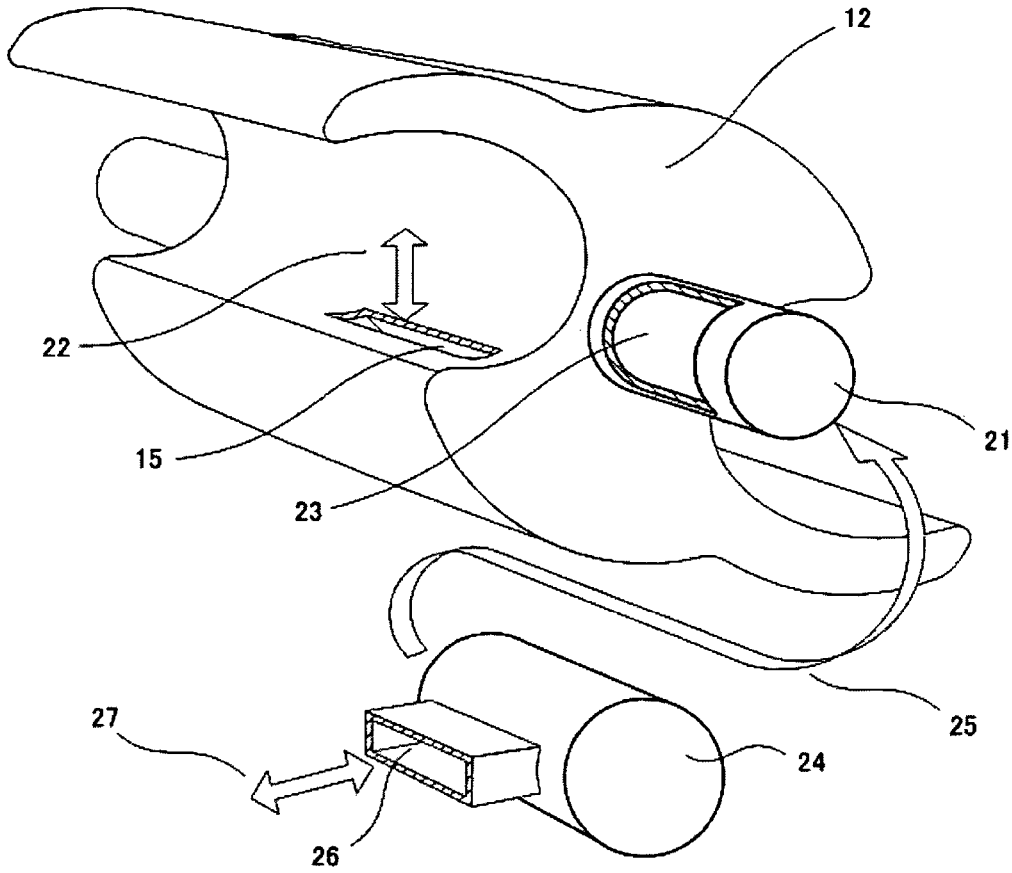
FIG. 5 is an assembly diagram illustrating a rotation member having a supply exhaust open-close mechanism in a shaft outside an outer wall.
Figure 6:
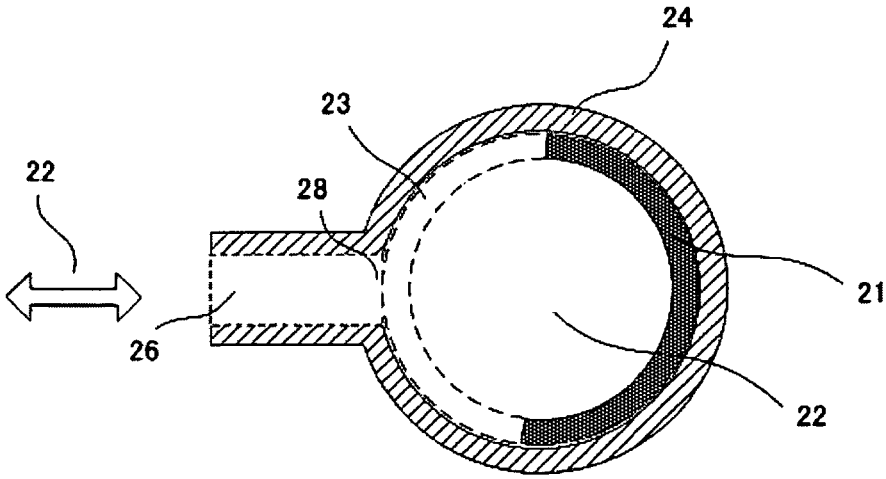
FIG. 6 is a cross-sectional view illustrating a valve of FIG. 5.

In addition to the supply and exhaustion using the rotation member 12 having a rotation shaft 13 therein as illustrated in FIG. 3, the supply and exhaustion using a rotation member 12 that has a rotation shaft 21 is illustrated with reference to FIG. 5 and FIG. 6. The rotation shaft 21 has a supply exhaust path therein, and the rotation member 12 and the rotation shaft 21 are integrated. In FIG. 5 and FIG. 6, a supply exhaust open-close mechanism (including 13, 17, and 18) disposed inside the rotation member illustrated in FIG. 3 is moved outside the side surface outer wall 33.

Figure 7:
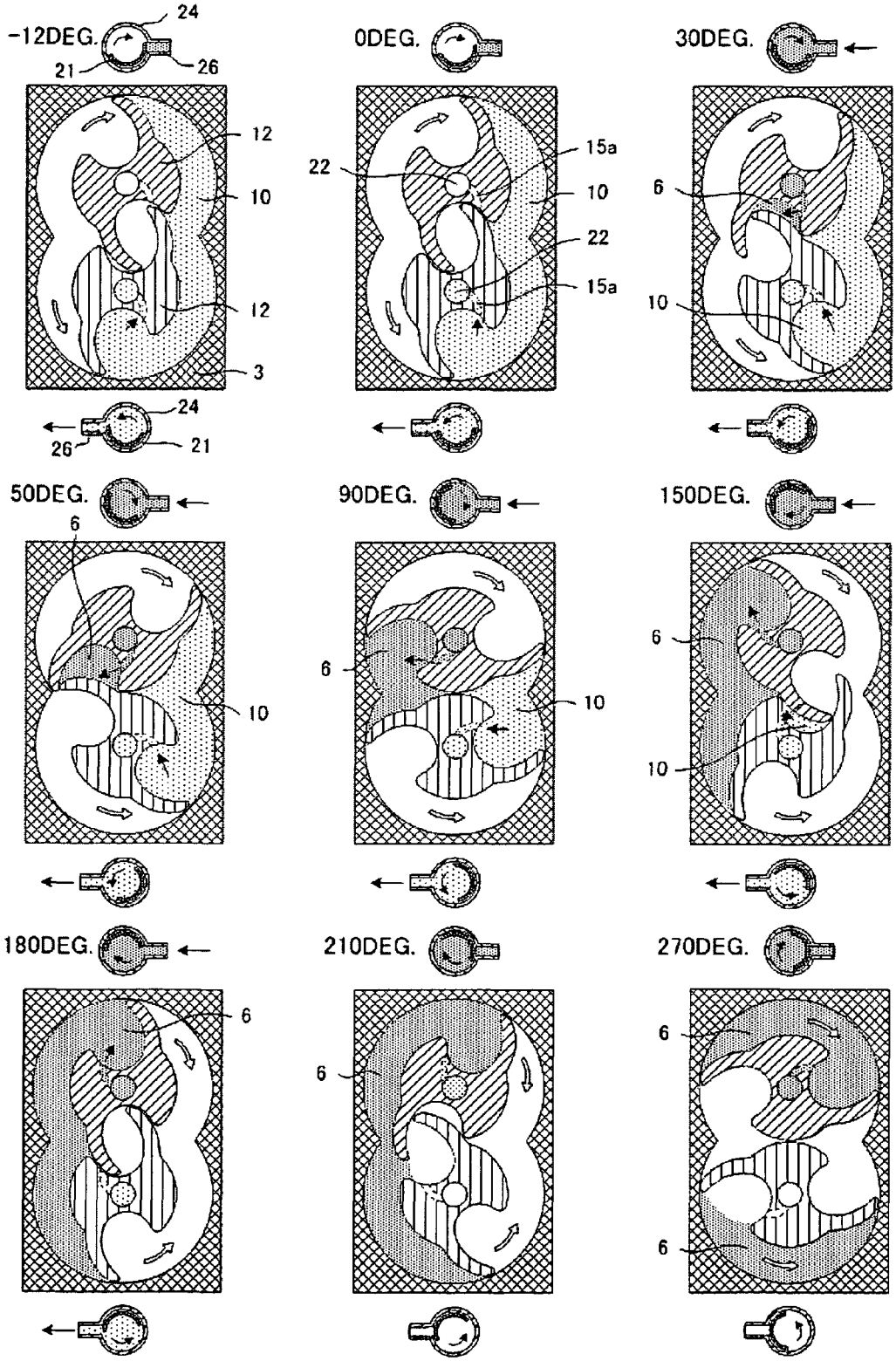
FIG. 7 are cross-sectional views illustrating angle changes of the rotation member having the supply exhaust open-close mechanisms in the shaft outside the outer wall.

The rotation shaft 21 having the supply exhaust path therein is fit into a rotation shaft support member 24 as illustrated in a cross-sectional view of FIG. 6, and a rotation member opening 15 and a rotation shaft valve opening 23 are connected through a flow path inside the rotation member 12. The rotation shaft 21 having the supply exhaust path therein rotates, and the rotation shaft support member 24 is secured to the side surface outer wall 33. The supply and exhaustion is performed at any angle in a case where the rotation shaft valve opening 23 and a rotation shaft support member valve opening 28 overlap each other. On the other hand, the supply and exhaustion is not performed at an angle in a case where the rotation shaft valve opening 23 and the rotation shaft support member valve opening 28 do not overlap each other. Therefore, the structure illustrated in FIG. 5 and the structure illustrated in FIG. 3 provide substantially the same function. Angle changes of the first enclosed space 6 are illustrated in FIG. 7.

Figure 8:
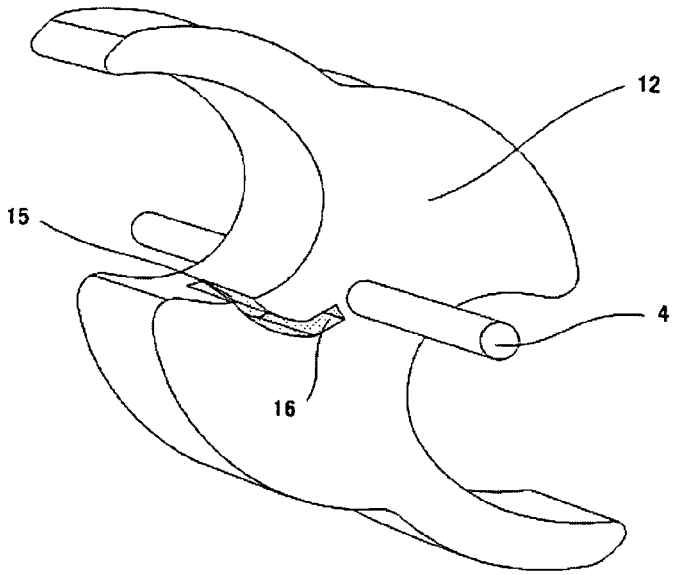
FIG. 8 is a cubic diagram illustrating a rotation member having a supply exhaust open-close mechanism on a side surface outer wall.
Figure 9:
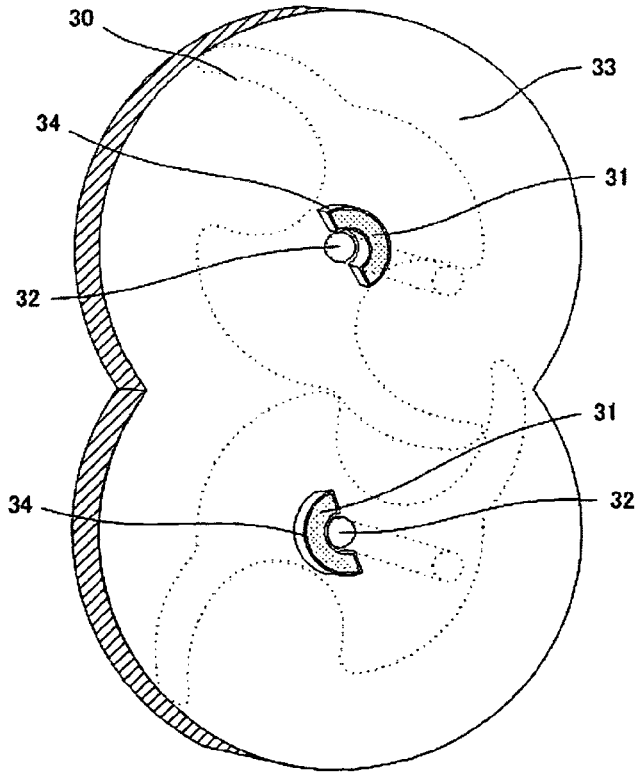
FIG. 9 is a cubic diagram illustrating the side surface outer wall of FIG. 8.

Referring to FIG. 8 and FIG. 9, supply and exhaustion using a side surface outer wall 33 that includes a valve mechanism therein is illustrated. A second rotation member 12 rotates by insertion of a rotation shaft 4 into a rotation shaft support hole 32. The supply and exhaustion is performed by opening a supply exhaust path in a case where a rotation member valve opening 16 overlaps with a side surface outer wall valve opening 31. In other words, the side surface outer wall 33 having the valve mechanism therein and the rotation member 12 include an open-close mechanism of the supply exhaust path. Therefore, the structure illustrated FIG. 8 and FIG. 9 and the structure illustrated in FIG. 3, FIG. 5, and FIG. 6 provide substantially the same function.

Figure 10:
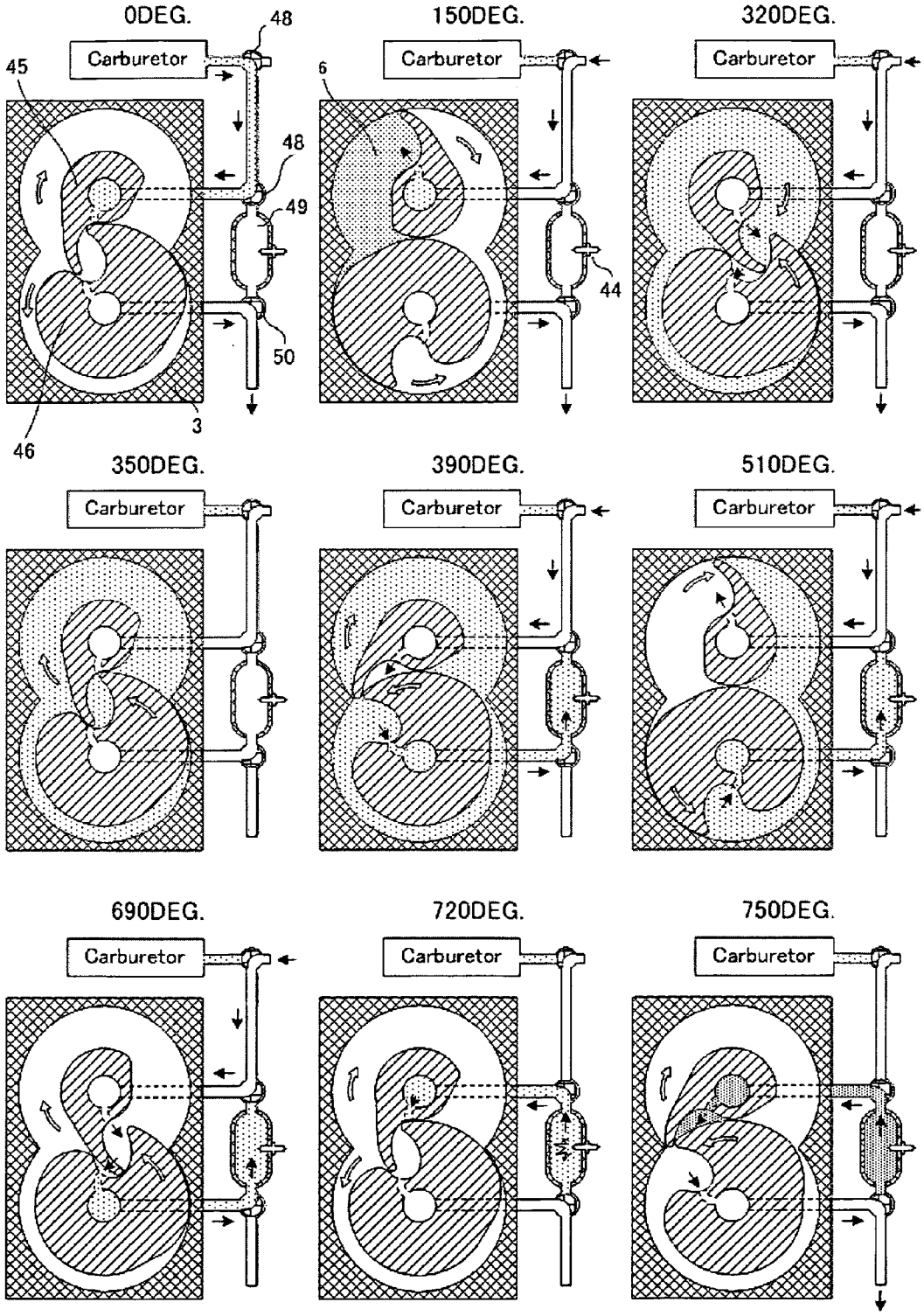
FIG. 10 are first cross-sectional views illustrating angle changes in a case of application to an engine (reference diagrams of a shape of a rotation member)
Figure 11:
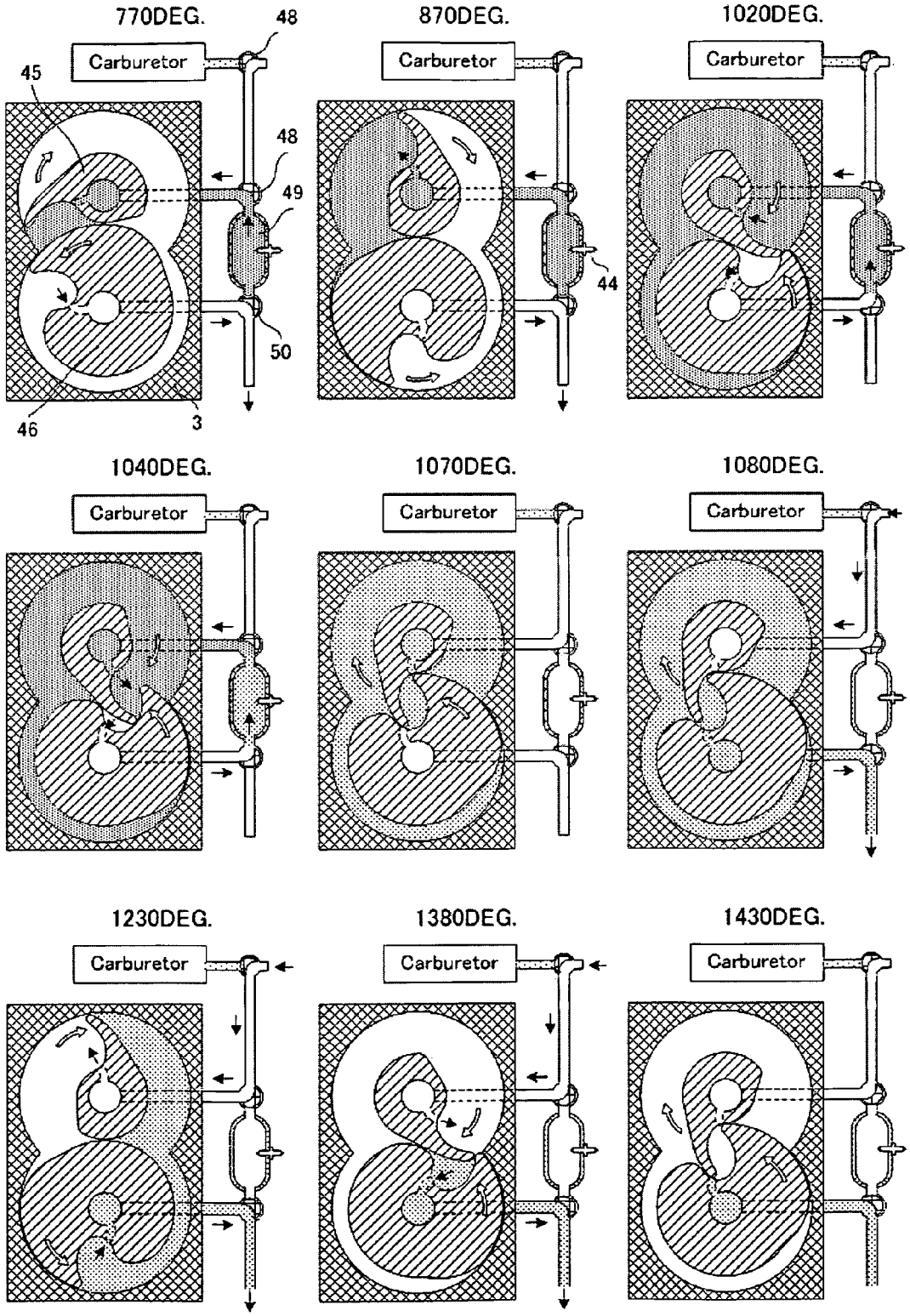
FIG. 11 are second cross-sectional views illustrating angles changes in a case of application to the engine (reference diagrams of a shape of a rotation member)

Referring to FIG. 10 and FIG. 11, a bi-directional converter of the present invention is applied to an engine. Here, a tank temporarily storing combustible gas is disposed outside the bi-directional converter which is applied to the engine, and the bi-directional converter includes a pair of rotation members to perform mix induction, compression, explosion, and exhaustion. A compression accumulation tank 49 is disposed outside the bi-directional converter so as to temporarily store mix compression of an engine system performed. Such a bi-directional converter uses an external tank to form compressed mix combustible gas by a rotation process, so that explosion power is generated by the compressed mix combustible gas, and the engine is provided. A fourth rotation member 45 includes an induction opening. Where a rotation angle of the fourth rotation member 45 is between zero (0) degree and one hundred fifty (150) degrees, where the rotation angle is between one hundred fifty (150) and three hundred sixty (360) degrees, and where the rotation angle is between three hundred sixty (360) to seven hundred twenty (720) degrees, the rotation member 45 inhales the combustible gas, inhales outside air, and supplies gas inside first enclosed space 6 to the compression accumulation tank 49 while compressing the gas, respectively. Consequently, the compression accumulation tank 49 stores the compressed mix gas of the combustible gas and the air. An ignition plug 44 is ignited at the rotation angle of seven hundred twenty (720)

degrees to explode the combustible compressed mix gas temporarily stored in the compression accumulation tank 49, so that the rotational force is provided by pressure generated by the explosion from the rotation angle of seven hundred twenty (720) degrees to one thousand and seventy (1,070) degrees. Subsequently, the bi-directional converter applied to the engine exhausts from the rotation angle of one thousand and eighty (1,080) degrees to one thousand four hundred and thirty (1,430) degrees. Therefore, the gas to be used from a fuel-air carburetor, the outside air, or the compression accumulation tank 49, can be selected based on the rotation angle. Similarly, the exhaustion and the compression can be performed based on the rotation angle of a fifth rotation member 46. Alternatively, two bi-directional converters of the present invention may be employed so as to perform mix compression of the combustible gas by one of the bi-directional converters and to obtain the rotational force generated by explosion by another one of the bi-directional converters.

The bi-directional converter having two rotation members has been described above. However, a number of rotation members can be increased more than three as illustrated in FIG. 12.

In a supply exhaust valve mechanism, a valve mechanism synchronized with rotation of the rotation member by a gear, a belt, a shaft, and the like may be employed as an alternative structure, and numerous variations can be possible.

Figure 14:
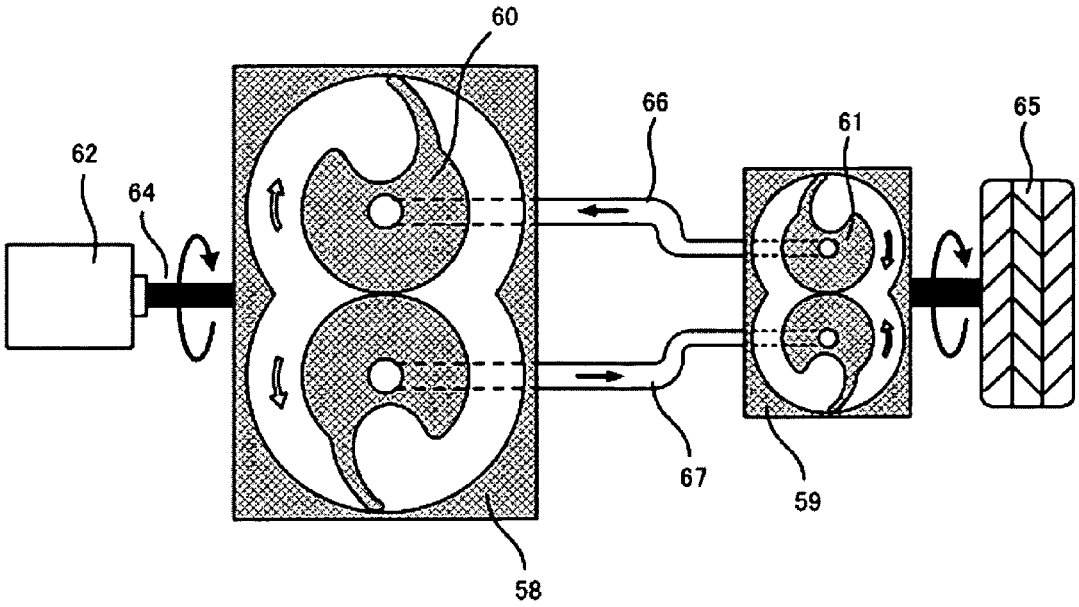
FIG. 14 is a cross-sectional view illustrating a bi-directional converter serving as a rotational force transmitter and as a transmission mechanism.
Figure 15:
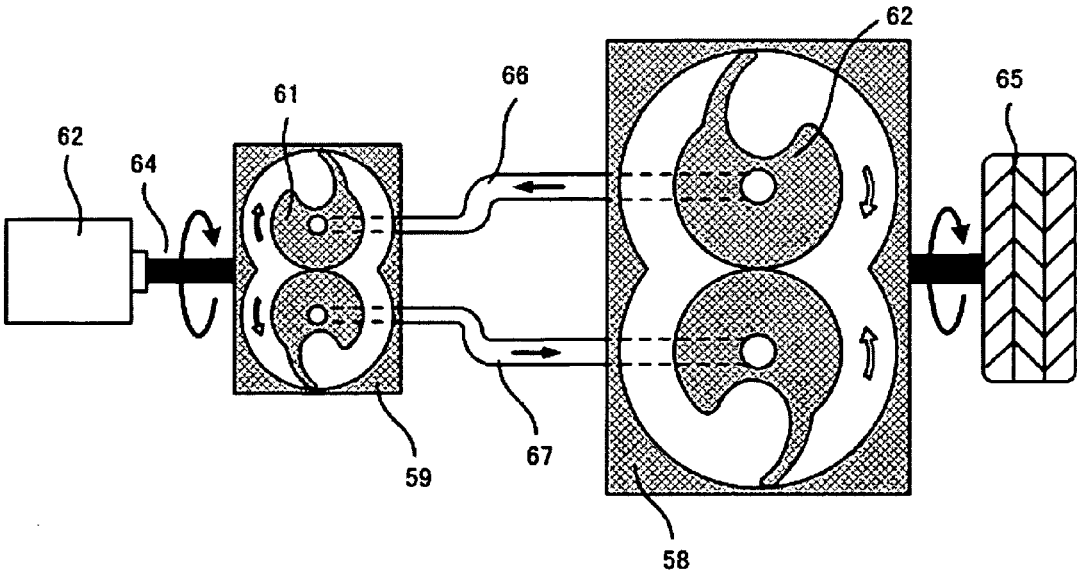
FIG. 15 is a cross-sectional view illustrating the bi-directional of one side piping of the rotational force transmitter.
Figure 16:
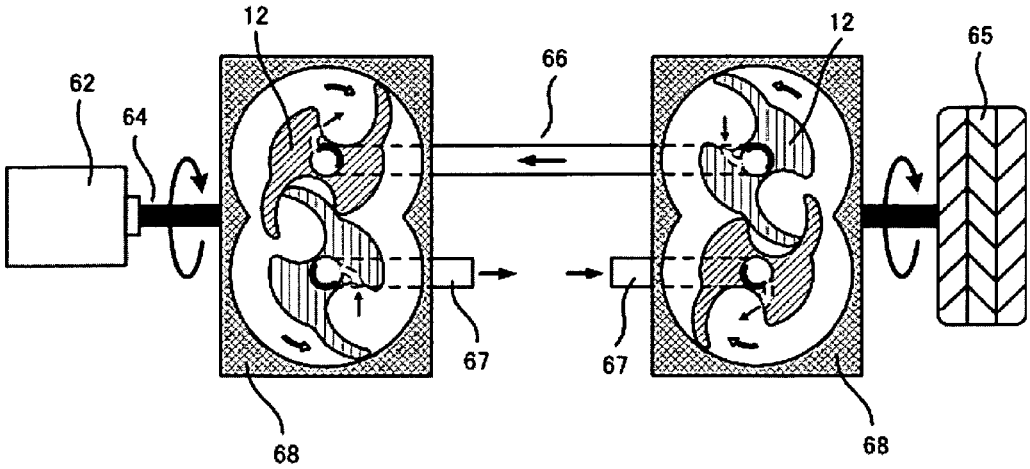
FIG. 16 is a cross-sectional view illustrating a situation in which one of supply exhaust paths of the rotational force transmitter is piped.
Figure 17:
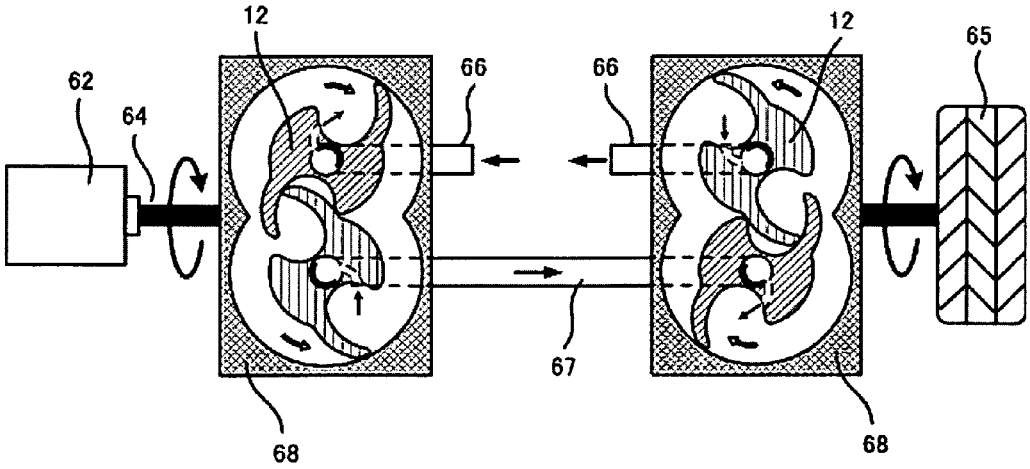
FIG. 17 is a cross-sectional view illustrating a situation in which one of supply exhaust paths of the rotational force transmitter is piped.

Referring to FIG. 14 and FIG. 15, pressure path pipes A-66 and B-67 are disposed to connect each of supply exhaust paths of two bi-directional converters. In this regard, one of the bi-directional converters is rotated by rotation of another one of the bi-directional converters, thereby serving as a transmission device of rotational force. In FIG. 14, a small capacity bi-directional converter 59 is disposed at a load side and is connected, through the pressure path pipes A-66 and B-67, to a large capacity bi-directional converter 58 driven by the rotational force. The small capacity bi-directional converter 59 has high speed of a rotation load member 65 with respect to a drive source 62 and has a transfer ratio of low torque according to a volume relation. In FIG. 15, the large capacity bi-directional converter 58 disposed at the load side is connected, through the pressure path pipes A-66 and B-67, to the small capacity bi-directional converter 59 driven by the rotational force, and has low speed of the rotation load member 65 with respect to the drive source 62 and the transfer ratio of high torque according to the volume relation. That is, a transmission mechanism is provided. Moreover, driving pressure is transferred even when one of pressure path pipes A-66 and B-67 is opened to the air as illustrated in FIG. 16 and FIG. 17. Therefore, the structure illustrated in FIG. 16 and FIG. 17 and the structure illustrated in FIG. 14 and FIG. 15 provide substantially the same function.

Figure 18:
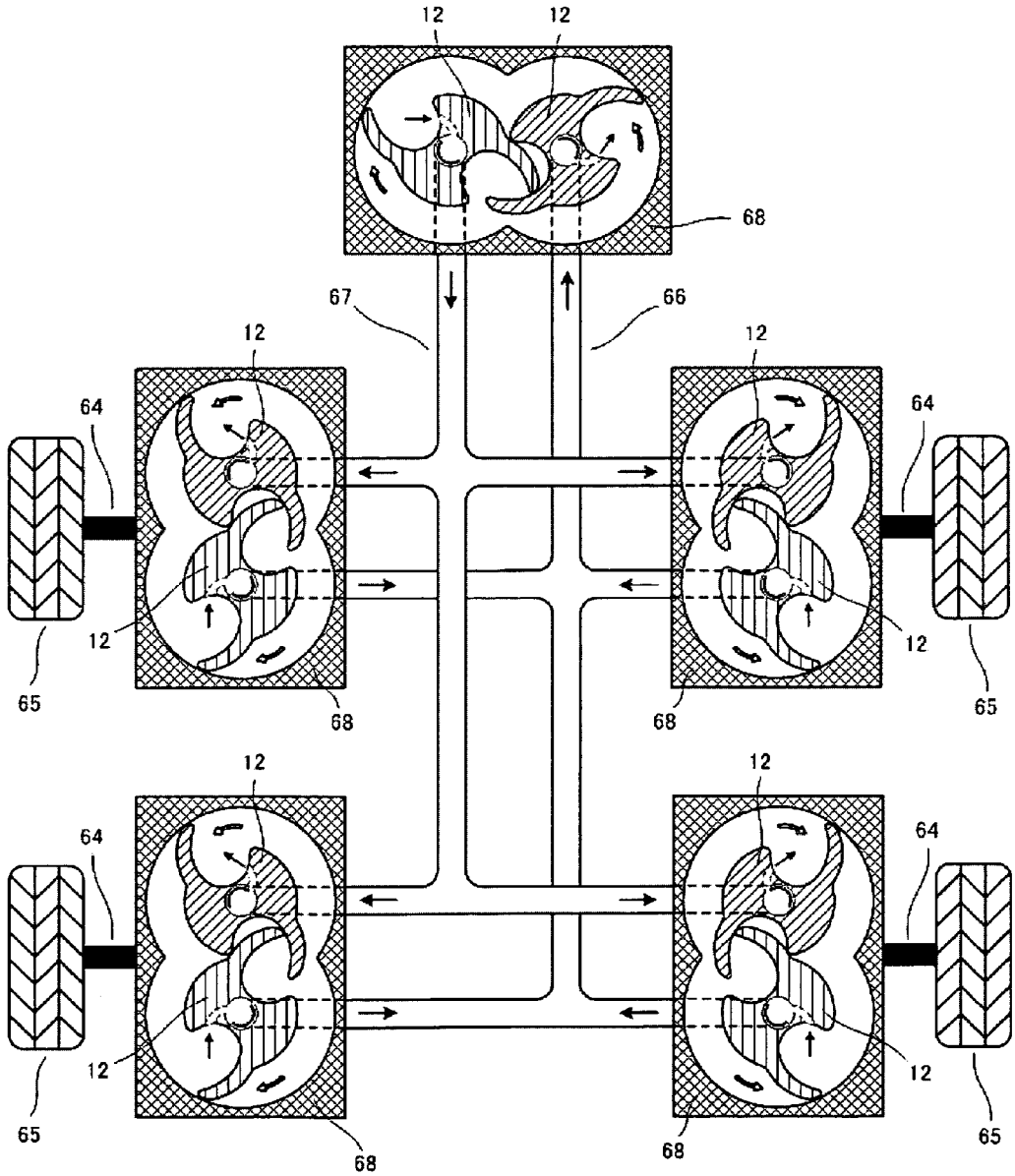
FIG. 18 is a schematic diagram illustrating an arrangement of four rotational loads piped in parallel.
Figure 19:
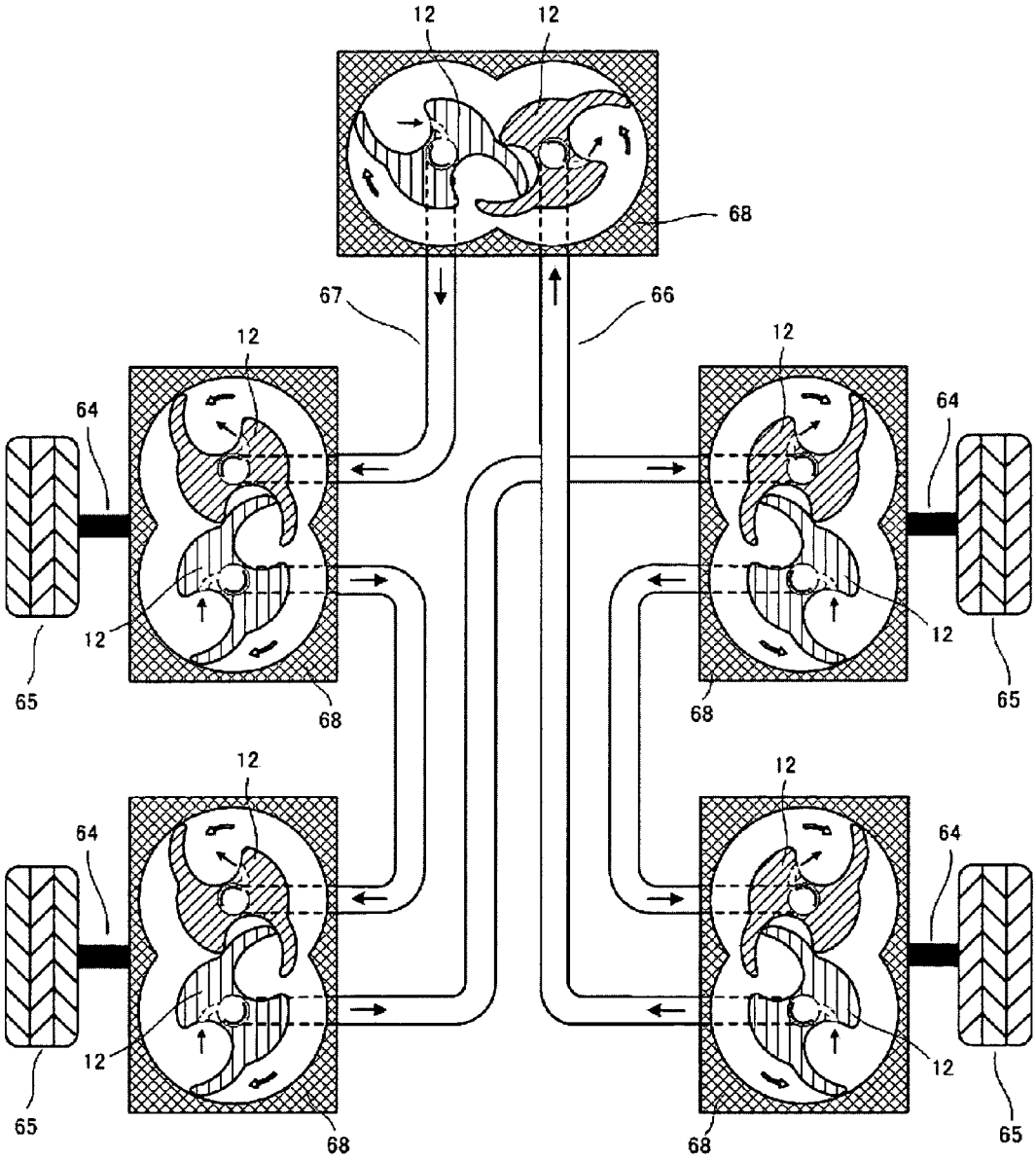
FIG. 19 is a schematic diagram illustrating an arrangement of four rotational loads piped in series.

In the transmission mechanism described above, the bi-directional converter disposed at the load side can be arranged as illustrated in FIG. 18 and FIG. 19. A plurality of such bi-directional converters can be arranged with the pressure paths in series and parallel.

Figure 20:
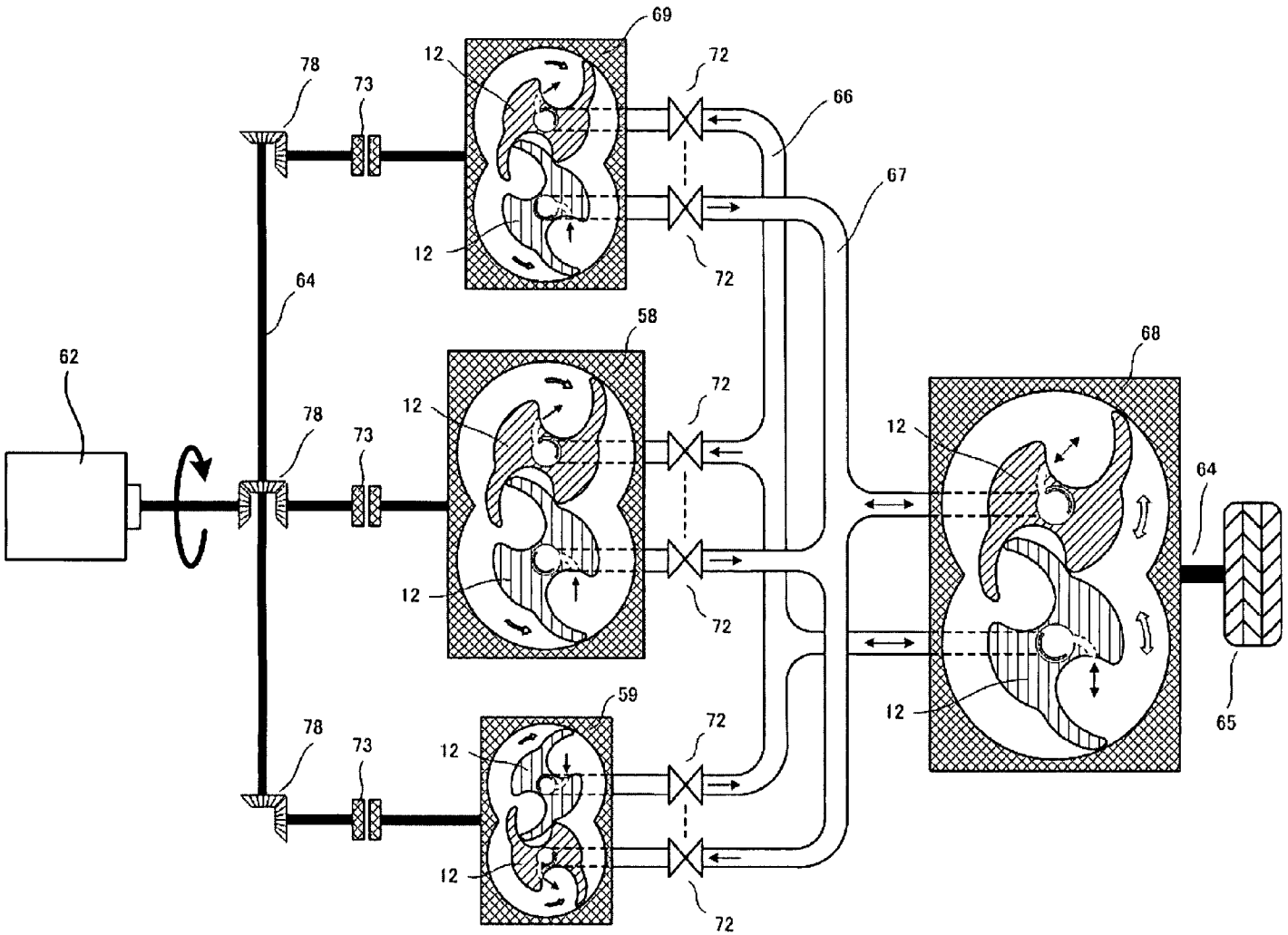
FIG. 20 is a schematic diagram illustrating a bi-directional converter serving as the rotational force transmitter using a clutch.
Figure 21:
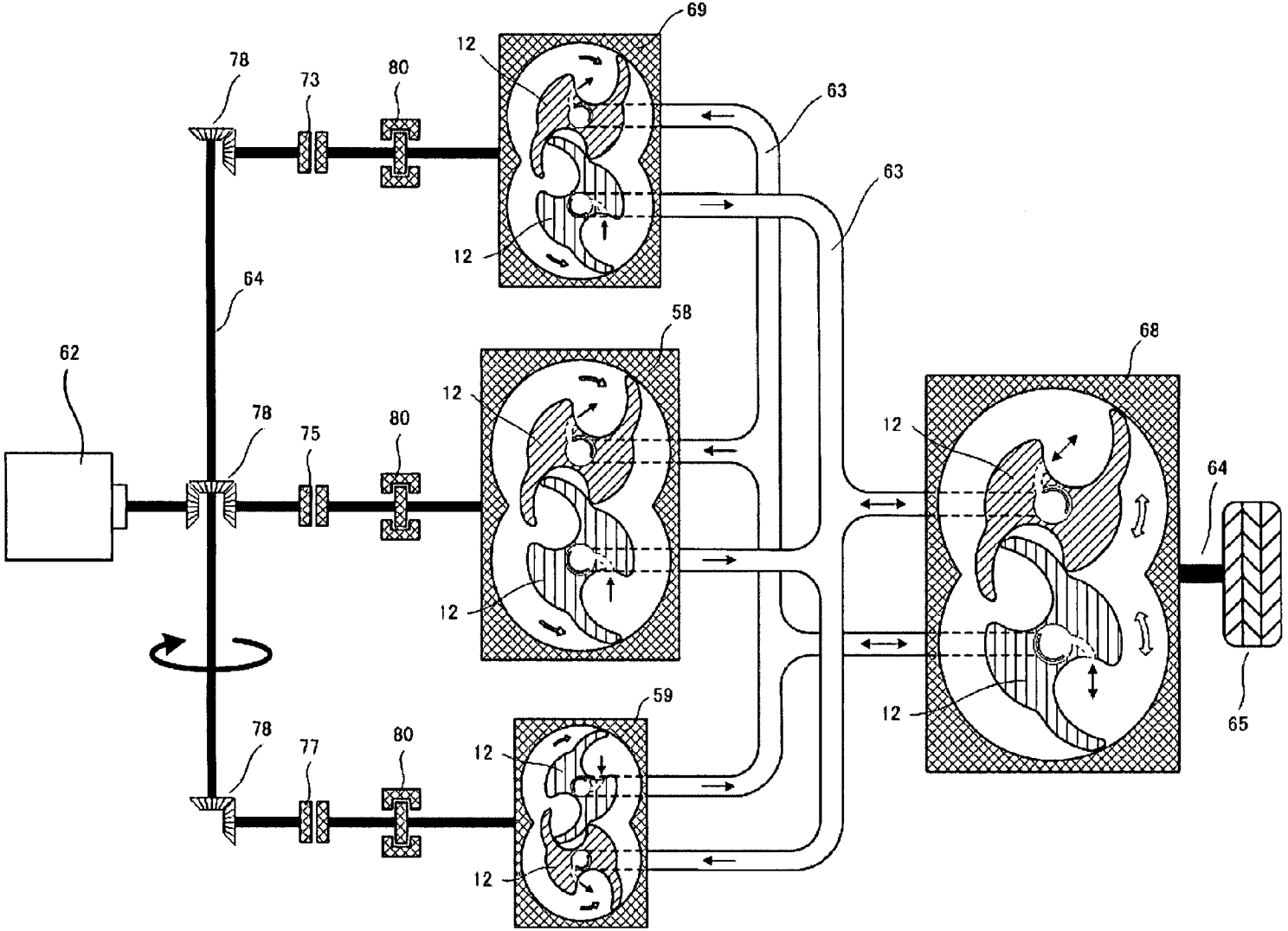
FIG. 21 is a schematic diagram illustrating a bi-directional converter serving as the rotational force transmitter using a brake.

The above-described bi-directional converter serving as the transmission mechanism disposed at a drive side can be arranged as illustrated in FIG. 20 and FIG. 21. A plurality of bi-directional converters having different volume of supply exhaust amounts are disposed at the drive side, and rotational force of a drive source 62 is connected to each of the bi-directional converters as illustrated in FIG. 20 and FIG. 21. In FIG. 20, associated operation between connection of each of connection breakers 73 and opening of each of flow path open-close valves 72, and associated operation between blocking of each of the connection breakers 73 and closing of each of the flow path open-close valves 72 for respective bi-directional converters are controlled, so that the bi-directional converter to generate a flow amount from the rotational force is selected. In FIG. 21, associated operation between connection of each of the connection breakers 73 and braking of each of brakes 80, and associated operation between blocking of each of the connection breakers 73 and releasing of each of the brakes 80 for respective bi-directional converters are controlled, so that the bi-directional converter to generate the flow amount from the rotational force is selected. As illustrated in FIG. 20 and FIG. 21, the high-capacity bi-directional converter 58, the middle-capacity bi-directional converter 69, and the small capacity bi-directional converter 59 have different capacities. When any one of such bi-directional converters is optionally selected and driven, a supply exhaust amount with respect to the rotation changes, thereby forming a transmission mechanism capable of arranging an optional transmission gear ratio. The small capacity bi-directional converter 59 rotates in an opposite direction relative to the bi-directional converters 69 and 58 in FIG. 20 and FIG. 21. Now, assuming that a transmission gear ratio is arranged for the bi-directional converters. The volume generated by one rotation of each of the bi-directional converters A, B, and C is arranged to be A=4, B=2, and C=−1, where A, B, and C represent the large capacity bi-directional converter 58, the middle capacity bi-directional converter 69, and the small capacity bi-directional converter 59, respectively. In such a case, the volume to be exhausted is expressed as follows.

$$B+C=1,\ B=2,\ A+C=3,\ A=4,\ A+B+C=5,\ A+B=6,\ \text{and}\ C=-1$$

That is, the transmission mechanism can provide seven (7) transmission levels including a reverse gear level.

Figure 22:
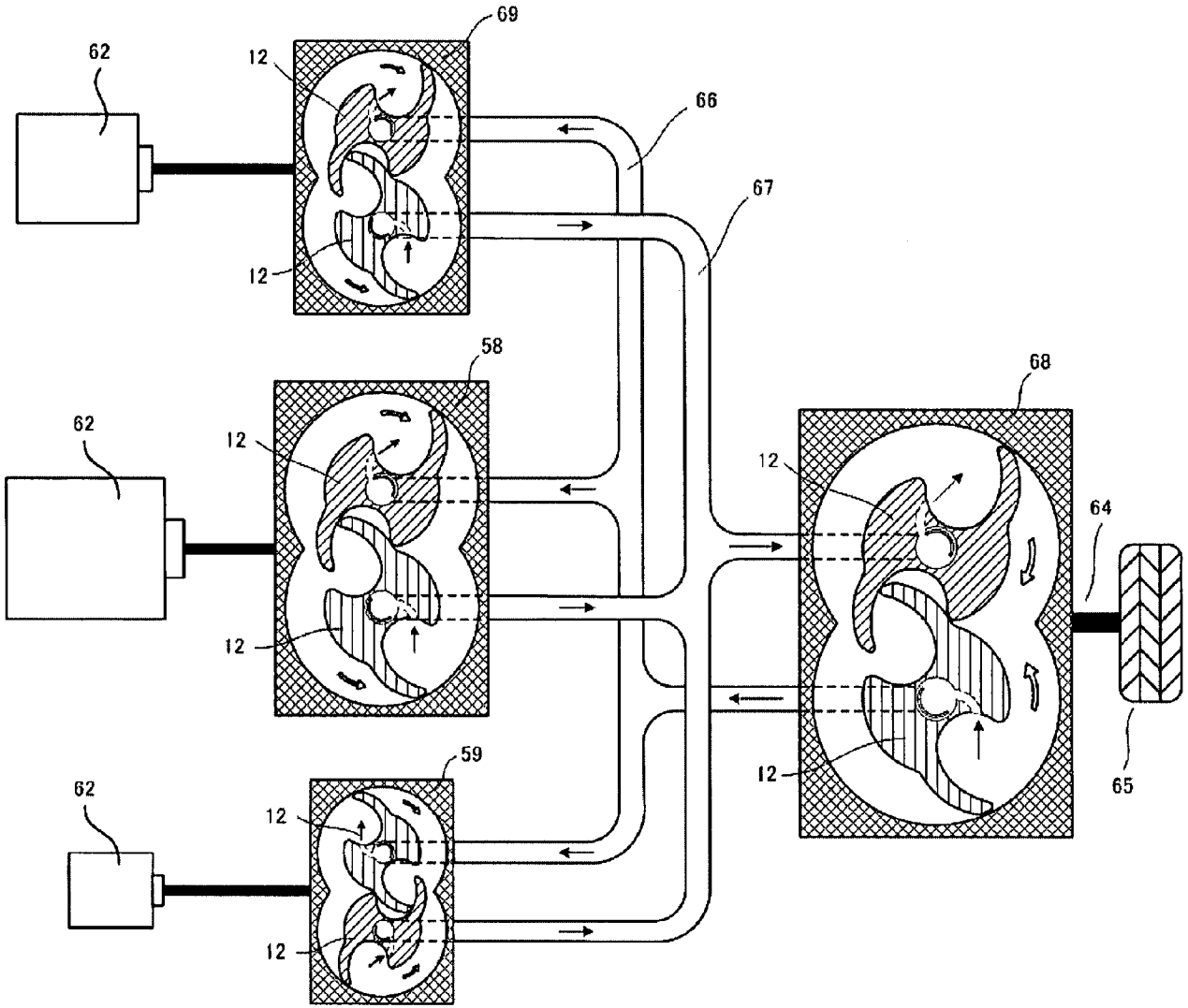
FIG. 22 is a schematic diagram illustrating rotational force of a mixing apparatus.

Referring to FIG. 22, a plurality of bi-directional converters disposed at the drive side are connected to respective drive sources 62. The pressure of each of the bi-directional converters that are driven is added and transferred to a bi-directional converter at a load side. Therefore, such a structure of the bi-directional converters can be applied as motive power for a mixing machine.

Explanation of Numerals

2: Rotation direction
3: Outer wall (outer circumference outer wall)
4: Rotation shaft
6: First enclosed space
7: Outer protrusion
8: First rotation member
10: Second enclosed space
11: Inner protrusion
12: Second rotation member
13: Rotation shaft (including valve mechanism inside)
14: Third enclosed space
15: Rotation member opening
16: Rotation member valve opening
17: Rotation shaft internal supply exhaust path
18: Rotation shaft valve opening
19: Rotational synchronization gear wheel
20: Engagement portion
21: Rotation shaft (including supply exhaust path inside)
22: Rotation shaft internal supply exhaust path
23: Rotation shaft valve opening
24: Rotation shaft support member
25: Mounting direction arrow
26: Supply exhaust path inside rotation shaft support member
27: Supply exhaust direction

28: Rotation shaft support member valve opening
30: See-through rotation member
31: Side surface outer wall valve opening
32: Rotation shaft support hole
33: Side surface outer wall
34: Side surface outer wall supply exhaust path
44: Ignition plug
45: Fourth rotation member
46: Fifth rotation member
48: Induction switch valve
49: Compression accumulation tank
50: Exhaustion switch valve
51: Sixth rotation member
52: Seventh rotation member
53: Eighth rotation member
55: Third rotation member
56: Fourth enclosed space
57: Fifth enclosed space
58: Large capacity bi-directional converter
59: Small capacity bi-directional converter
60: Large capacity rotation member (pressure-rotational force)
61: Small capacity rotation member (pressure-rotational force)
62: Drive source
64: Rotation shaft
65: Rotation load member
66: Pressure path pipe A
67: Pressure path pipe B
68: Bi-directional converter (pressure and rotational force)
69: Middle capacity bi-directional converter
72: Flow path open-close valve
73: Connection breaker
78: Rotational force binding gear
80: Brake

What is claimed is:

1. A bi-directional converter between pressure and rotational force, comprising:

first and second rotation members, disposed next to each other while overlapping a portion of each of outer circumference tracks thereof, having different rotation shafts, each of the outer circumference tracks being in a circular cylinder shape;

a circumference outer wall adjacent to the outer circumference track of each of the first and the second rotation members;

a side surface outer wall, adjacent to a side surface of each of the rotation members, serving as a surface in a direction perpendicular to the rotation shafts of respective the rotation members;

an enclosed space formed by each of the first and second rotation members, the circumference outer wall, and the side surface outer wall; and a supply exhaust path communicating an inner side of the circumference outer wall with an outer side of the side surface outer wall, wherein one of the rotation shafts of the first and the second rotation members rotates in such a manner to synchronize with the other rotation member rotating in the opposite direction, wherein each of the first and the second rotation members includes a protrusion portion serving as an outer protrusion, being adjacent to the circumference outer wall, and protruding from a base in a substantially circular shape, and includes a convex portion, serving as an inner protrusion, disposed at an inner circumference side relative to the outer circumference track, the convex portion of one of the first and second rotation members becoming adjacent to the outer protrusion of the other of the first and second rotation members in a course of engagement of the first and the second rotation members, wherein the outer protrusion of the first rotation member is curved in a retard direction with respect to a rotation direction and forms an arc at a front surface of the outer protrusion in the rotation direction while forming a recess in a curve shape from a rotation direction rear surface to a tip of the inner protrusion of the outer protrusion so as to form a curve surface successively adjacent to the outer protrusion of the second rotation member in contact with the first rotation member, wherein the outer protrusion of the second rotation member is curved in an advance direction with respect to a rotation direction and forms an arc at a rear surface of the outer protrusion in the rotation direction while forming a recess in a curve shape from the front surface of the outer protrusion in the rotation direction to a tip of the inner protrusion of the outer protrusion so as to form a curve surface successively adjacent to the outer protrusion of the first rotation member in contact with the second rotation member, wherein adjacency of the tip of the outer protrusion of the second rotation member and the curve surface of the first rotation member and adjacency of a surface of the arc of the outer protrusion of the second rotation member and the curve surface of the tip of the inner protrusion of the first rotation member form two adjacent enclosed space in the course of engagement of the first rotation member and the second rotation member adjacent to each other, wherein adjacency of the outer protrusion of the second rotation member and the curve surface of the first rotation member makes an adjacent movement moving toward the outer protrusion from the inner protrusion, wherein adjacency of the circumference outer wall and the outer protrusion of the first rotation member, adjacency of the circumference outer wall and the outer protrusion of the second rotation member, and adjacency of the first rotation member and the second rotation member are formable of three adjacent enclosed space, and wherein a volume change of the enclosed space by rotation of the first and the second rotation members is converted into a pressure difference, and volume of the enclosed space is changed by the pressure applied from outside the enclosed space to convert into the rotational force of the first and the second rotation members.

2. The bi-directional converter between the pressure and the rotational force according to claim 1, wherein each of the first rotation member and the second rotation member includes an opening of the supply exhaust path to the enclosed space.

3. The bi-directional converter between the pressure and the rotational force according to claim 1, comprising a side wall supply exhaust path being through the side surface outer wall and an opening of the supply exhaust path in the side surface outer wall, wherein the first and second rotation members include a rotation member internal supply exhaust path communicating a rotation member opening with respect to the enclosed space with a rotation member valve opening facing the side surface outer wall, and wherein the rotation member internal supply exhaust path and the side wall supply exhaust path communicate the enclosed space with outside of the outer wall by opposition of the rotation member valve opening with respect to the side wall supply exhaust path at a prescribed rotational position around the rotation shaft of the first and second rotation members.

4. The bi-directional converter between the pressure and the rotational force according to claim 1, wherein the rotation shafts are secured to the side surface outer wall through a center of the respective first and second rotation members, wherein the first and second rotation members rotate around the respective rotation shafts and include a rotation member internal supply exhaust path communicating a rotation member opening with respect to the enclosed space with a rotation member valve opening facing the rotation shafts, wherein the rotation shafts of the respective first and second rotation members include a rotation shaft internal supply exhaust path extending inside thereof in an axis direction from a rotation shaft first valve opening facing the rotation member, and wherein the rotation member internal supply exhaust path and the rotation shaft internal supply exhaust path make the rotation member valve opening and the rotation shaft first valve opening be opposite to each other at a prescribed rotation position around the rotation shaft of the respective first and second rotation members.

5. The bi-directional converter between the pressure and the rotational force according to claim 1, comprising a rotation shaft support member rotatably support the rotation shafts integrally rotating with the first and second rotation members, wherein the first and second rotation members include a rotation member rotation shaft internal supply exhaust path communicating with a rotation shaft second valve opening facing the rotation shaft support member through inside the first and second rotation members and the rotation shaft from a rotation member opening with respect to the enclosed space, wherein the rotation shaft support member includes a rotation member bearing opening having a support member internal supply exhaust path communicating outside the rotation shaft support member and to the rotation shafts; and wherein the rotation member rotation shaft internal supply exhaust path and the support member internal supply exhaust path make the rotation shaft second valve opening and the rotation member bearing opening be opposite each other at a prescribed rotation position around the rotation shaft support member of the first and second rotation members.

6. The bi-directional converter between the pressure and the rotational force according to claim 1, wherein each of the first and second rotation members includes a plurality of the outer protrusions and the inner protrusions.

7. The bi-directional converter between the pressure and the rotational force according to claim 1, comprising a valve, disposed outside, connecting to the enclosed space, wherein drive of the valve and the rotation shafts of the first and second rotation members are connected to open and close of the valve with respect to a rotation angle of the respective first and second rotation members.

8. The bi-directional converter between the pressure and the rotational force according to claim 1 serving as a motive power apparatus such as a turbine or an engine obtaining the rotational force from the pressure applied to the enclosed space.

9. The bi-directional converter between the pressure and the rotational force according to claim 8, wherein the motive power apparatus performs induction and compression of combustible gas based on a volume change of the enclosed space, and wherein the compressed combustible gas is temporarily stored in a compression accumulation tank disposed outside the enclosed space and the combustible gas is exploded to obtain the rotational force by pressure of the explosion.

10. The bi-directional converter between the pressure and the rotational force according to claim 1, wherein the pressure difference based on the volume change of the enclosed space is guided to outside through the supply exhaust path.

11. A bi-directional converter between pressure and rotational force, comprising:

one of at least one pair of the bi-directional converters of claim 1 serving as a drive bi-directional converter; and another one of the pair of the bi-directional converters of claim 1 serving as a load bi-directional converter, wherein at least one of two supply exhaust paths of the drive bi-directional converter and at least one of two supply-exhaust paths of the load bi-directional converter are communicated, wherein the drive bi-directional converter generates pressure for driving by reception of rotational force, and the load bi-directional converter rotates by the pressure for driving to drive a rotation load, and wherein a volume difference being as supply exhaust amounts of the drive bi-directional converter and the load bi-directional converter is arranged to form a transmission mechanism.

12. The bi-directional converter between pressure and rotational force according to claim 11, wherein the load bi-directional converter drives a plurality of load bi-directional converters by communication of the supply exhaust paths of the plurality of load bi-directional converters in series or parallel.

13. The bi-directional converter between pressure and rotational force according to claim 11, wherein the supply exhaust path of a plurality of the drive bi-directional converters is communicated in parallel and the rotation shafts of the drive bi-directional converters are connected to a drive source while a connection breaker and a valve are respectively disposed to the rotation shaft and the supply exhaust path of each of the drive bi-directional converters, wherein the connection breaker and the valve of each of the drive bi-directional converters are optionally open and closed, the rotational force of the drive bi-directional converter is serving as an input and the rotational force of the load bi-directional converter is serving as an output, and wherein a supply exhaust amount with respect to the rotational force is changed by a combination of selection of operation of the optional connection breaker and the valve to form a transmission mechanism changing rotation speed and rotation torque of the load bi-directional converter.

14. The bi-directional converter between pressure and rotational force according to claim 13, wherein all of the supply exhaust paths are communicated inside the valve and a brake is disposed to the rotation shafts between each of the connection breaker and the drive bi-directional converter to form the transmission mechanism releasing and braking.

15. The bi-directional converter between pressure and rotational force according to claim 11, wherein the supply exhaust paths of the plurality of drive bi-directional converters are communicated in parallel, and each of drive sources is connected to each of the rotation shafts of the drive bi-directional converters, wherein the rotational force of the plurality of drive bi-directional converters is serving as an input, and the rotational force of the load bi-directional converter is serving as an output, and wherein rotation speed and rotation torque of the plurality of drive sources are collected to the rotational force of the load bi-directional converter.

* * * * *